US006014933A

United States Patent [19]

Umphries et al.

[11] Patent Number: 6,014,933

[45] Date of Patent: Jan. 18, 2000

[54] DOWNHOLE CHARGE CARRIER

[75] Inventors: Donald V. Umphries, New Iberia, La.; Harold D. Owen; Bobby R. Ford, both of Fort Worth, Tex.; David S. Wesson, Desoto, Tex.

[73] Assignees: Weatherford US Holding, L.P. a Louisiana Limited Partnership; Owen Oil Tools, Inc.

[21] Appl. No.: 08/942,631

[22] Filed: Oct. 2, 1997

Related U.S. Application Data

[63] Continuation of application No. 08/108,903, Aug. 18, 1993.

[51] Int. Cl.[7] ..... F42B 3/00; E21B 7/00

[52] U.S. Cl. ..... 102/312; 102/313; 175/4.6; 89/1.15

[58] Field of Search ..... 89/1.15; 102/312, 102/313; 175/4.57, 4.6, 4.54; 166/297

[56] References Cited

U.S. PATENT DOCUMENTS

| | | | |
|---|---|---|---|
| 2,169,559 | 8/1939 | Halliburton | 166/1 |
| 2,200,487 | 5/1940 | Calvert | 164/0.5 |
| 2,690,123 | 9/1954 | Kanady . | |
| 2,749,841 | 6/1956 | Jones . | |
| 2,760,435 | 8/1956 | Jones . | |
| 2,761,383 | 9/1956 | Sweetman | 102/20 |
| 2,833,214 | 5/1958 | Spenar | 102/20 |
| 2,873,676 | 2/1959 | Caldwell | 102/20 |
| 2,889,774 | 6/1959 | Allen | 89/1.15 X |
| 2,927,534 | 3/1960 | Le Bus | 89/1.15 X |
| 2,965,031 | 12/1960 | Johns | 89/1.15 X |
| 3,016,014 | 1/1962 | Lebourg | 89/1.15 X |
| 3,018,730 | 1/1962 | Castel | 102/313 X |
| 3,048,101 | 8/1962 | Lebourg | 102/20 |
| 3,181,608 | 5/1965 | Palmer . | |
| 3,415,321 | 12/1968 | Venghiattis . | |
| 4,467,878 | 8/1984 | Ibsen | 175/4.6 |
| 4,541,487 | 9/1985 | Revett | 166/297 |
| 4,543,703 | 10/1985 | Wetzel et al. | 175/4.6 X |
| 4,552,234 | 11/1985 | Revett . | |
| 4,583,602 | 4/1986 | Ayers | 175/4.51 |
| 4,621,396 | 11/1986 | Walker et al. | 29/1.3 |
| 4,635,734 | 1/1987 | Donavan et al. | 175/4.6 |
| 4,726,431 | 2/1988 | Oestriech et al. | 175/4.6 |
| 4,739,839 | 4/1988 | Regalbuto et al. . | |
| 4,744,424 | 5/1988 | Lendermon et al. | 175/4.57 |
| 4,773,299 | 9/1988 | Oestreich et al. | 89/1.15 X |
| 4,844,170 | 7/1989 | Gill . | |
| 4,951,744 | 8/1990 | Rytlewski | 102/313 X |
| 4,960,171 | 10/1990 | Parrott et al. . | |
| 5,054,564 | 10/1991 | Oestreich et al. . | |
| 5,070,943 | 12/1991 | Walker et al. | 166/297 |
| 5,111,885 | 5/1992 | Umphries . | |
| 5,155,293 | 10/1992 | Barton | 102/312 |
| 5,295,544 | 3/1994 | Umphries . | |
| 5,323,684 | 6/1994 | Umphries . | |
| 5,388,521 | 2/1995 | Coursen | 102/313 X |
| 5,619,008 | 4/1997 | Chawla et al. | 102/313 X |

*Primary Examiner*—Peter A. Nelson
*Attorney, Agent, or Firm*—Tobor, Goldstein & Healey, L.L.P.

[57] ABSTRACT

An improved downhole explosive charge carrier is disclosed. The invention uses a unique staggered charge pattern and a mounting configuration which allows the use of a straight, axially-located detonator in order to achieve a greater number of shots per unit length over conventional carriers. The invention also reduces the interference caused by the detonator and the closeness of the shots and thereby increases the performance of the individual charges, allowing smaller charges to be used to achieve the same perforation size.

17 Claims, 5 Drawing Sheets

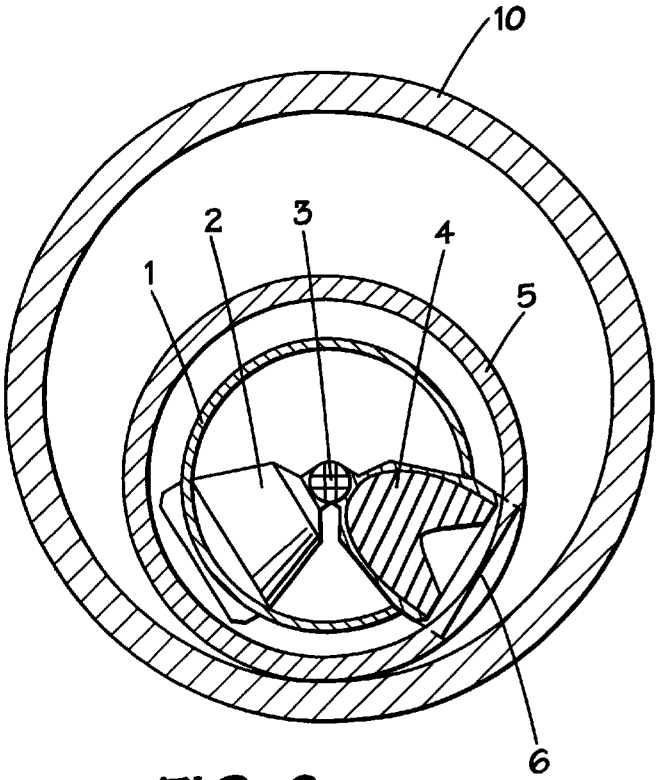
FIG. 6
FIG. 5
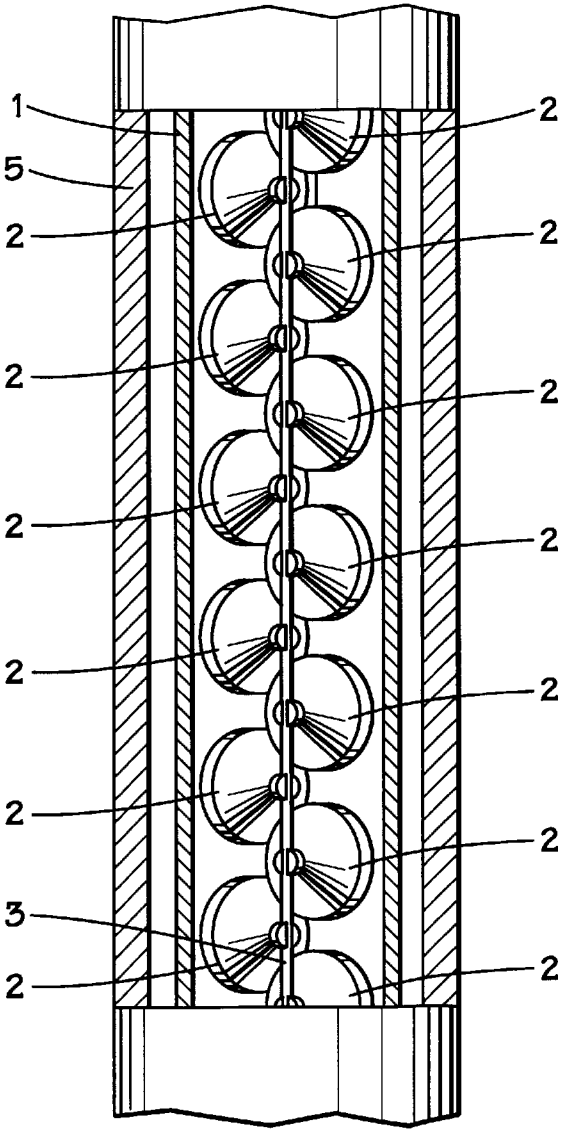

DOWNHOLE CHARGE CARRIER

This application is a continuation of Ser. No. 08/108,903, filed Aug. 18, 1993.

BACKGROUND OF THE INVENTION

This invention relates to an explosive carrier for the perforation of downhole casing and the penetration of earth formation therefrom during oil and gas production operations.

In oil and gas operations, perforating through casing using a perforating gun is probably the most important of all completion jobs in cased holes. After a casing is properly placed in a drilled hole, a charge carrier carrying explosive charges is lowered downhole. Charges are fired to effectuate perforations through the steel casing and into the earth formation therefrom, thereby providing communication between the wellbore and the desired producing zones.

In conventional charge carriers, the explosive charges are arranged in a spiral configuration. To minimize interference between the charges, the explosive charges in single-spiral conventional carriers are spaced at 60° phasing and at a vertical distance of about 2 inches. Such a conventional configuration results in a shot density of 6 shouts per foot. Because of the limited spacing, there is a certain amount of interference between the firing of shots. Due to the pressure wave generated by neighboring shots and by the detonator itself, the hole size is often significantly smaller than that which could be achieved if no such interference existed.

With these charge carriers, in order to achieve a desired flow rate, the same cased hole often has to be shot twice. The charge carrier is first lowered into the wellbore, and shots are fired. The carrier is then pulled back to the surface and reloaded with charges. The charge carrier is then lowered again into the wellbore and refired. Safety is a serious concern in such multiple trip operations due to the use of explosives. Some of the explosive charges may not have properly detonated and could explode at the surface and cause serious injury.

Because the charge carrier must be lowered twice, the possibility that the carrier may get stuck in the pipe and require a laborious fishing job is doubled. Multiple trips also consume significant rig time, which could be very expensive, especially during offshore operations. If the charge carrier is not properly positioned in the second run, it could end up shooting the same hole twice. A multiple shooting also carries the risk of splitting the casing when two shots are fired together.

Increased shot density has been achieved in conventional charge carriers by arranging the charges in three spirals, 120° out of phase with each other. These charge carriers can achieve 12 shots per foot, but still retain several of the disadvantages of single-spiral charge carriers. First, the shots of the three spirals are clustered so that each shot is grouped at the same axial position as two others, even though the shots are 120° out of phase circumferentially. This clustering of three shots at each level leaves the layers of earth between each cluster unperforated. Since it is the nature of subterranean hydrocarbons to flow along the layers of bearing strata, conventional charge carriers leave some producing strata unperforated.

Multi-spiral conventional carriers also retain the single-spiral carriers' problem of interference between shots and the resulting decrease in hole size. Multi-spiral conventional carriers also detonate the charges in the same manner as single-spiral conventional carriers, and thus suffer from the same type of interference found in the single-spiral carriers. The problem is aggravated by the detonation of the charges in a single spiral, followed by the next spiral, and so on.

Finally, multi-spiral conventional carriers typically use 120° phasing between spirals and 60° phasing between individual charges in a given spiral. This configuration results in reduced casing strength, because it places multiple perforations on each plane of failure (which runs perpendicular to the application of load on the casing). The casing, thus weakened, is subject to a much greater risk of crushing and the well therefore bears a much greater risk of costly rework. The present invention distributes the perforations around the wellbore so that the number of perforations on each plane of failure is reduced, thereby retaining most of the strength of the original unperforated well casing.

SUMMARY OF THE INVENTION

The primary object of the present invention is to provide a downhole explosive charge carrier for the perforation of a downhole casing and the penetration of earth therefrom.

Another object of the present invention is to provide an improved explosive charge carrier having an improved pattern for mounting explosive charges which is capable of providing a higher shot density, i.e., greater number of shots per unit length and/or increasing the hole size of each perforation relative to the conventional charge carrier.

Yet another object of the present invention is to provide a downhole explosive charge carrier having an improved charge mounting pattern that will substantially reduce the pressure drop near the wellbore with minimum interference between perforation shots.

Yet another object of the present invention is to provide a downhole explosive charge carrier having an improved charge mounting pattern that will perforate a greater number of layers of earth in a single perforation job.

Yet another object of the present invention is to provide a downhole explosive charge carrier having an improved charge mounting pattern that will maintain casing integrity by eliminating the need for multiple perforation jobs on the same casing and by eliminating holes on the same plane of failure.

Yet another object of the present invention is to provide a downhole explosive charge carrier that will enhance safety and increase performance by utilizing smaller explosive charges than conventional charge carriers to produce the same size perforations.

In this invention, the explosive charges are arranged in a unique staggered spiraling configuration. The mounting pattern of the explosive charges is defined by the track of circumferential movements accompanied by axially downward as well as upward movements. This contrasts the spiral configuration of a conventional charge carrier, in which the mounting pattern of the explosive charges is defined by the track of circumferential movements accompanied by only axially downward movements.

With the new mounting pattern disclosed in the present invention, the number of shots that can be fired per unit length of a carrier is increased, while the spacing between fixed shots is actually increased, thereby substantially reducing the interference therebetween and resulting in greater perforated hole size. Even when two or three spirals are used in a conventional gun, the shots are clustered in groups of 2 or 3 at certain axial points, resulting in shorter distances between shots than in the present invention and increased interference between them. The distance between shots in the present invention is increased and the interference thus decreased by staggering the shots from the conventional spiral pattern. This staggered pattern insures that no two shots are at the same axial point and allows the number of shots per foot of axial length to be increased to 16 from the 12 possible in conventional carriers.

The interference is further reduced by using a single detonating cord running along the axis of the carrier to detonate all the shots. Conventional carriers' detonation of each spiral consecutively increases the interference and reduces the size of the resulting perforations.

BRIEF DESCRIPTION OF THE DRAWINGS

FIG. 5 is a revealed view of a 1-foot section of the "low side" embodiment of the present invention.

FIG. 6 is a cross-sectional view of the "low side" embodiment of the present invention.

DETAILED DESCRIPTION OF THE PREFERRED EMBODIMENT

Figure 1:
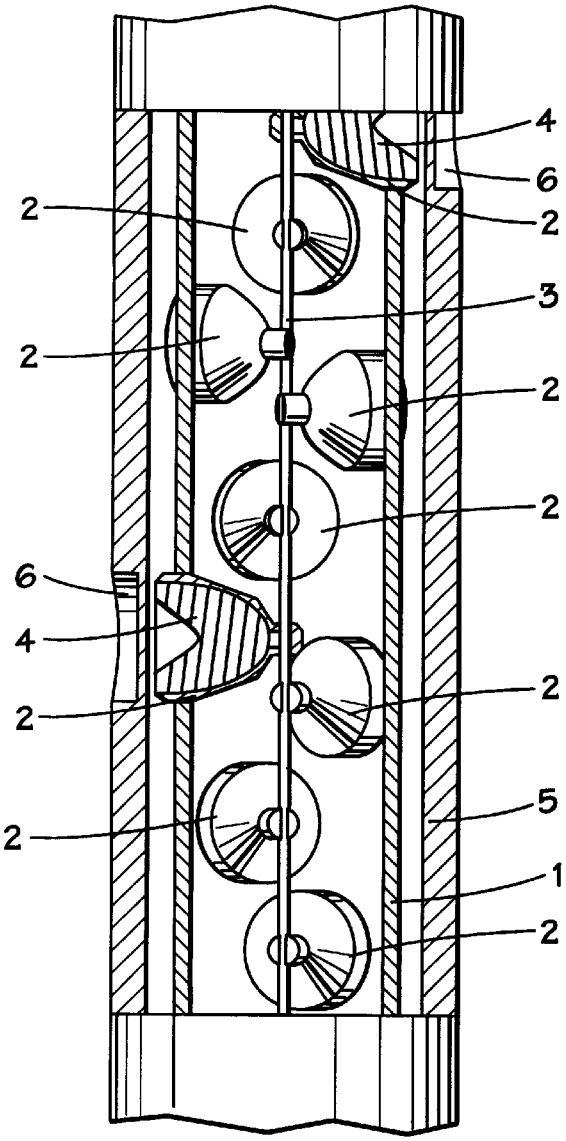
FIG. 1 is a revealed view of a portion of a 1-foot section of the preferred embodiment of the present invention.

FIG. 1 is a revealed view of a section of the preferred embodiment of the improved charge carrier of the present invention. FIG. 1 shows the inner cylinder 1 with charge holders 2 mounted on it. The preferred embodiment uses a prima cord 3 to detonate the charges 4 which are placed within the charge holders 2. This assembly is then placed inside the outer shell 5 and oriented so that the charge holders are radially aligned with corresponding scalloped or thin-walled areas 6 on the outer shell 5.

The charge holders 2 are mounted on the inner cylinder 1 by drilling holes in the cylinder which are dimensioned to allow the charge holders to fit partially through them. The charger holders are wide enough at their open ends to prevent them from passing entirely through the holes and are held in place by the outer cylinder. The mounting arrangement of the charge holders also maintains the detonator ends of the charge holders on the axis of the inner cylinder so that the prima cord detonator will run straight down the center of the cylinder, thereby reducing the interference caused by the detonation of the prima cord.

Figure 3:
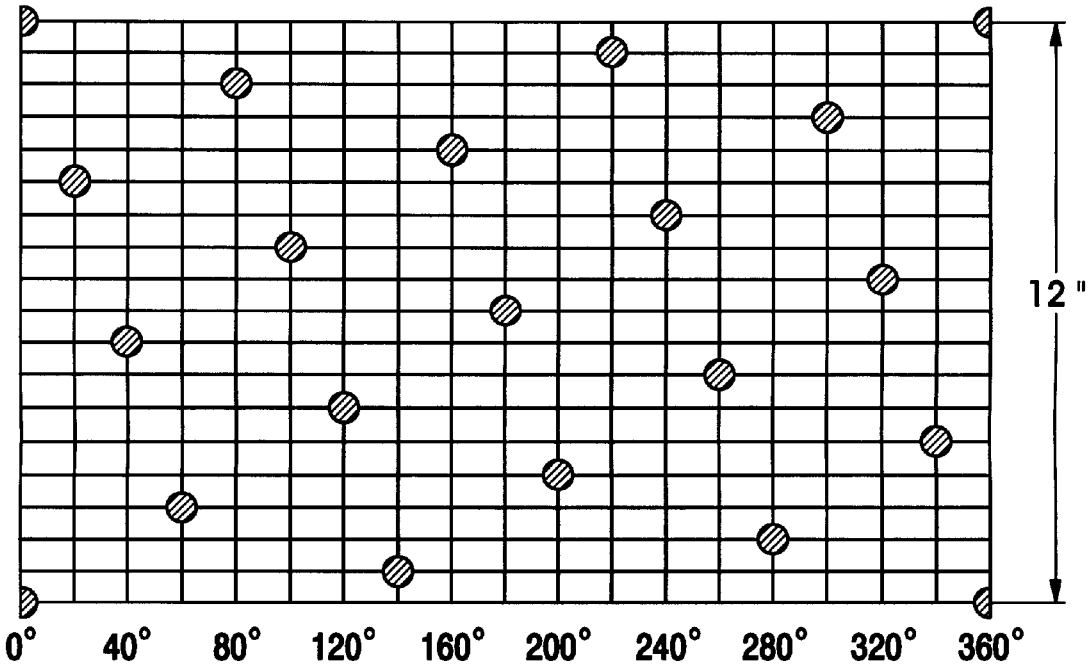
FIG. 3 is an illustration of the angular and axial positions of the charge holders in the preferred embodiment of the present invention.

The charge holders are mounted on the inner cylinder in a staggered spiral configuration. The open ends of the charge holders, into which the charges are placed, face radially outward from the cylinder's axis. The projection of the charge holders onto the casing to be perforated is shown in FIG. 3. FIG. 3 shows that, as the angular position of the charge holders is steadily incremented, the axial position is incremented for several charge holders, then decremented for one, then incremented for several, then decremented for one, and so on. FIG. 3 shows the configuration which is optimized for the preferred embodiment, which has an outer diameter of 7 inches. This configuration uses angular increments of 20° with axial increments of 3¾ inches and decrements of 9¾ inches and results in a shot density of 16 shouts per foot.

Figure 4:
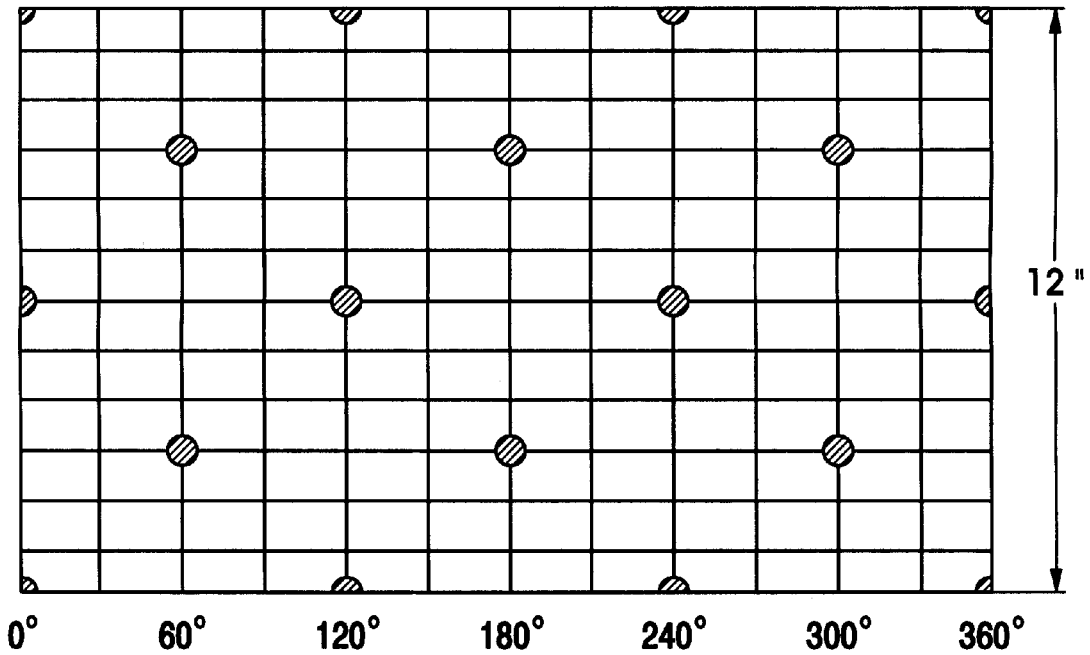
FIG. 4 is an illustration of the angular and axial positions of the charge holders in a conventional hollow carrier.

In FIG. 3, the successive shots are labeled A1, A2, A3, . . . A16, which are offset circumferentially from one another by 140°. In that regard, shot A2 is circumferentially offset 140° from shot A1, shot A3 is circumferentially offset 140° from shot A2, etc. Further, successive shots are offset axially from one another by ¾ of an inch. In that regard, the axial distance between shots A1 and A2 is ¾ of an inch as is the axial distance between shots A2 and A3, etc. The particular optimal axial and angular increments, as well as the resulting number of shots per foot, may vary with the carrier diameter of a given embodiment. FIG. 4 shows the projection of the charge holder configuration of a typical conventional multi-spiral charge carrier. Conventional carriers typically use three spirals which are 120° out of phase with each other. Each spiral has 4 shots per foot and adjacent charges are 60° out of phase.

There are three distinct advantages to use the configuration of the present invention over the conventional configuration.

First, the staggering of the spirals so that no two charges are at the same axial point increases the distance between successive charges and thereby both reduces the interference between them and increases the resulting perforation size. The increased distance between the charges also allows the present invention to accommodate more charges per unit length than a conventional carrier. The distance between the charges can also be increased by optimizing the angular distance between the charges.

The second advantage of this staggered spiral configuration concerns the strength of the casing after it has been perforated. Conventional configurations place clusters of two or three charges at the same axial point and thereby place two or three perforations on the plane of failure running through that point. This severely reduces the crush strength of the casing with respect to axial loads. Similarly, several perforations are placed on the plane of failure for lateral loads so that the risk of the casing being crushed laterally is increased.

Finally, the clustering of the shots at certain axial points in a conventional configuration may cause a hydrocarbon-producing layer of earth to remain unperforated if it lies between the clusters of shots. For example, FIG. 4 shows an axial gap of 3 inches between the 3 uppermost shots and the 3 adjacent shots. The configuration of the present invention spreads out those shots to insure that no producing layer is unperforated. FIG. 3 shows that the axial distance between any 2 adjacent shots is not more than ¾ of an inch.

Figure 8:
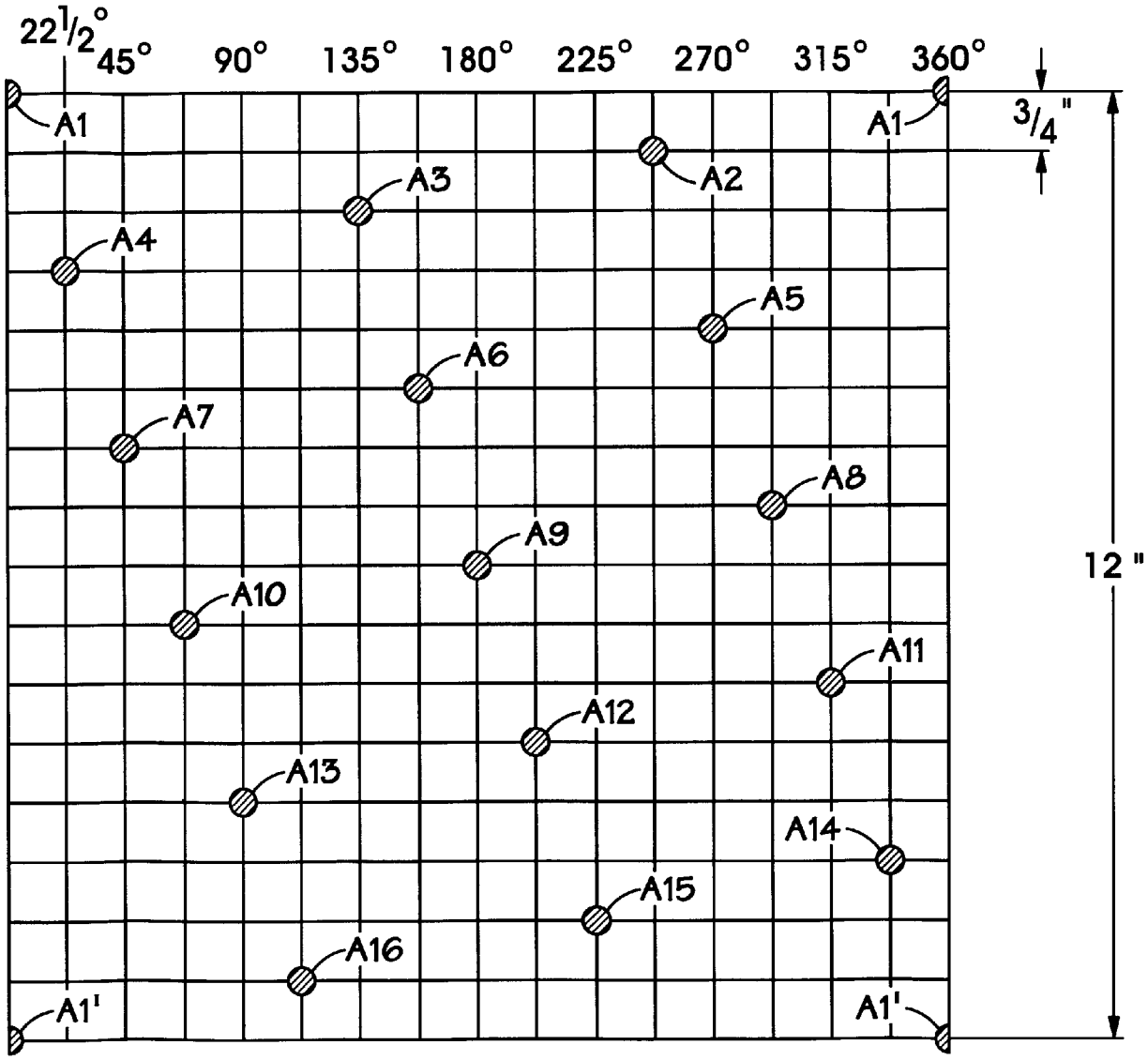
FIG. 8 is an illustration of the angular and axial positions of the charge holders in another embodiment of the present invention.

An alternative embodiment of the invention has an outer diameter of 4½ inches or 4⅝ inches uses angular increments of 22½°, axial increments of 2¼ inches and axial decrements of 9¾ inches, as shown in FIG. 8. In this embodiment, the greatest axial distance between two adjacent charges is again ¾ of an inch and the staggered pattern prevents the presence of more than one perforations on the various planes of failure.

In FIG. 8, successive shots are labeled A1, A2, A3 . . . A16 and are offset circumferentially from one another by 112½°. In that regard, shot A2 is circumferentially offset 112½° from shot A1, shot A3 is circumferentially offset 112½° from shot A2, etc. Further, successive shots are offset axially from one another by ¾ of an inch. In that regard, the axial distance between shots A1 and A2 is three quarters of an inch, as is the axial distance between shots A2 and A3, etc.

Figure 2:
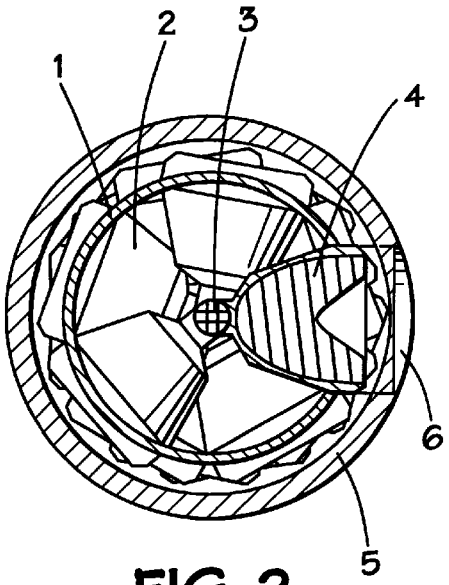
FIG. 2 is a cross-section perpendicular to the axis of the preferred embodiment of the present invention.

Referring again to FIGS. 1 and 2, the preferred embodiment uses prima cord 3 to detonate the explosive charges 4. Prima cord is itself explosive and is one of the sources of the interference which reduces the effectiveness of the explosive charges in perforating the well casing. In conventional charge carriers, the prima cord detonator is loosely looped through the ends of the charge holders. The charge holders are also configured so that their ends are not aligned with each other. The prima cord must therefore be strung from one side of the inner cylinder to the other, weaving a path through the length of the charge carrier. This tangled length of prima cord, when detonated, generates a significant and somewhat unpredictable shock wave through the charge carrier.

In the present invention, the charge holders are aligned so that the prima cord lies along the axis of the charge carrier. This placement of the detonator uses the shortest possible length of prima cord and thus reduces its explosive power. It also makes the remaining interference more predictable since the detonator's position is more regular and well defined.

The reduction of interference, both from adjacent charges and from the prima cord detonator, is one of the greatest advantages of the invention over the prior art. The reduction of interference leads to improvements in performance, economy, and safety.

As mentioned above, the reduction of interference results in larger perforations than can be achieved with conventional carriers. This increased performance is substantial enough that the present invention can use smaller charges than conventional carriers yet still produce more regular and larger perforations, thereby leading to greater production from the well while increasing safety due to the use of smaller charges.

In addition to the improved efficiency and economy of being able to use smaller charges, the present intention improves the economy of perforating operations by producing a cleaner hole through the outer shell of the carrier. The reduction of burrs created by perforation of the shell reduces the risk of the carrier being caught in the wellbore as it is removed after being fired. The possibility of costly fishing jobs and rework is thereby reduced as well.

The advantages of the present invention are not confined to the staggered spiral configuration described above. The axial staggering of shots and the reduction of interference in the manner described above also improve the performance of "low side" charge carriers. These charge carriers are designed to perforate only the low side of a well casing which is not vertically oriented.

The added constraint of perforating only the low side of the casing reduces the range of angular positions which the charge holders may occupy in a full-angular-range charge carrier. The improvements of this invention can nonetheless be incorporated in a low side embodiment of the present invention. The charge holders in a conventional low side carrier are clustered in groups at given axial positions. In the present invention, the charge holders are staggered axially so that no two have the same axial position. The charge holders in the low side embodiment of this invention are again mounted so that the detonator runs along the axis of the carrier and so that the resulting interference is reduced.

Figure 7:
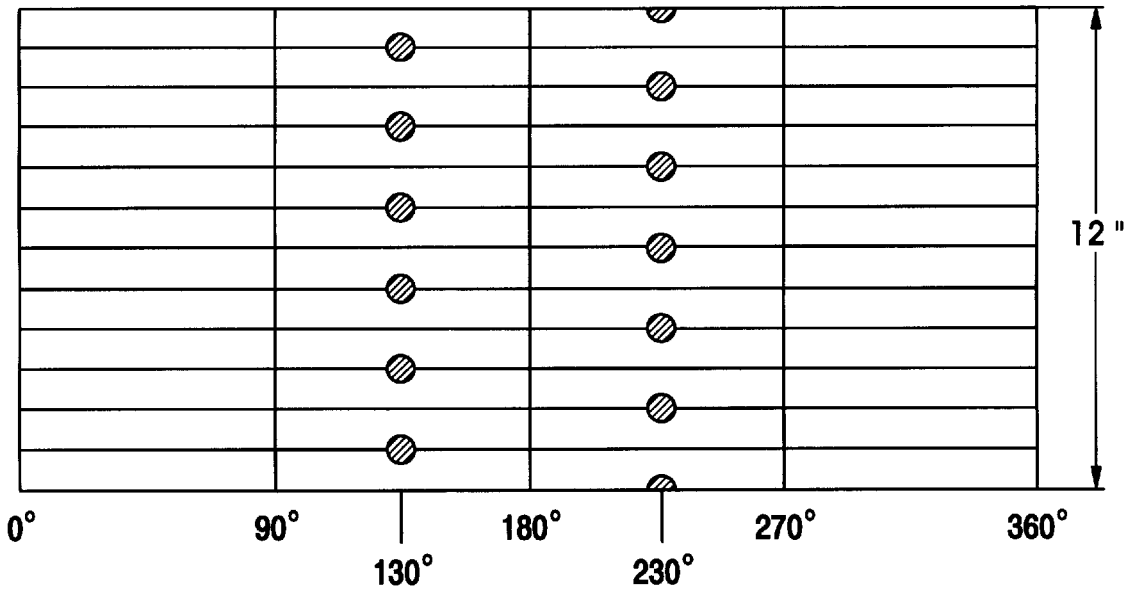
FIG. 7 is an illustration of the angular and axial positions of the charge holders in the "low side" embodiment of the present invention.

FIG. 5, a revealed view of the low side carrier, shows the configuration of the charge holders. Since the charge holders are confined to a 120° angular range, none of the charge holders are cut away in the figure, as they were in FIG. 1. FIG. 5 also shows the detonator 3 which is placed on the axis of the carrier to reduce interference. FIG. 6, a cross-sectional view of the low side carrier, shows the alignment of all the charge holders in two rows, as well as their orientation with respect to the well casing 10 to be perforated. FIG. 7 shows the configuration of the charge holders as projected onto a flat surface.

While the low side embodiment of the present invention does not achieve the number of shots per foot that can be achieved by the preferred embodiment, this is a constraint of the particular situation in which the low side carrier is used. Similarly, the placement of several shots on planes of failure which intersect the charger carrier's axis and each row of shots is a constraint of the situation and not a failing of the invention. The low side embodiment, in comparison to conventional low side charge carriers, does reduce the number of shots on each plane of failure perpendicular to the carrier's axis, thereby maintaining the invention's casing-strength advantage over the conventional low side carrier. The low side embodiment of this invention provides increased performance, economy, and safety over conventional low side carriers in the same manner in which they are provided by the preferred embodiment over conventional charge carriers.

Although the best mode contemplated for practicing the present invention, as well as alternative embodiments, have been described above, it will be apparent to those skilled in the art that modifications may be made to these embodiments without departing from the subject matter of the invention.

What is claimed is:

1. A perforating apparatus comprising:

a substantially cylindrical carrier having a longitudinal axis;

a plurality of explosive charges which are connected successively to said carrier and which face outwardly from said longitudinal axis, where the axial distance between axially sequential charges is not greater than ¾ inch and where no two of said charges are mounted within a given plane perpendicular to said longitudinal axis; and a detonator operationally connected to said explosive charges.

2. The perforating apparatus of claim 1, wherein:

said detonator extends substantially along said longitudinal axis.

3. The perforating apparatus of claim 1, further including:

a gun body, said carrier and said explosive charges being disposed in said gun body.

4. The perforating apparatus of claim 1, wherein:

said successive charges are circumferentially spaced from one another at an angle between 90 degrees and 180 degrees.

5. The perforating apparatus of claim 1, wherein:

said successive explosive charges are circumferentially spaced from each other by an angle of 140 degrees.

6. The perforating apparatus of claim 1, wherein:

said successive explosive charges are circumferentially spaced from each other by an angle of 112.5 degrees.

7. The perforating apparatus of claim 1, wherein:

said successive charges are axially spaced ¾ inch from one another.

8. The perforating apparatus of claim 1, wherein:

greater than 12 said charges are connected per axial foot.

9. The perforating apparatus of claim 1, wherein:

at least 16 said charges are connected per axial foot.

10. A perforating apparatus comprising:

a perforating gun body;

a substantially cylindrical carrier having a longitudinal axis, mounted within said gun body;

a plurality of explosive charges which are connected successively to said carrier and which face outwardly from said longitudinal axis, where the axial distance between axially sequential charges is not greater than ¾ inch, where no two said charges are mounted within a given plan perpendicular to said longitudinal axis, and where two charges having the same circumferential location are axially spaced apart by at least one foot; and a detonator operationally connected to said explosive charges.

11. A perforating apparatus comprising:

a perforating gun body;

a substantially cylindrical carrier having a longitudinal axis, mounted within said gun body;

an array of explosive charges successively connected to said carrier, wherein said successive charges are axially spaced no greater than ¾ inch from each other and circumferentially spaced between 90 and 180 degrees from each other.

12. The perforating apparatus of claim 1, wherein said successive explosive charges are circumferentially spaced from one another by 135 degrees.

13. The perforating apparatus of claim 10, wherein axially sequential charges are circumferentially spaced from one another by an angle $\alpha$ between 90 and 180 degrees.

14. The perforating apparatus of claim 10 or 13, wherein the angle by which axially sequential charges are circumferentially spaced is determined by the formula $\alpha=X/Y\cdot 360°$, where X/Y is reduced to its simplest form, $y>12$ and $Y/2>X>Y/4$.

15. The perforating apparatus of claim 14, wherein the angle $\alpha$ is 140°.

16. The perforating apparatus of claim 14, wherein the angle $\alpha$ is 112.5°.

17. The perforating apparatus of claim 10, wherein successive charges are axially spaced ¾ inch from one another.

* * * * *